US005623897A

United States Patent [19]

Hampton et al.

[11] Patent Number: 5,623,897

[45] Date of Patent: Apr. 29, 1997

[54] ENGINE VALVE CONTROL SYSTEM USING A LATCHABLE ROCKER ARM ACTIVATED BY A SOLENOID MECHANISM

[75] Inventors: Keith Hampton, Ann Arbor; David M. Preston, Clarkston, both of Mich.

[73] Assignee: Eaton Corporation, Cleveland, Ohio

[21] Appl. No.: 622,239

[22] Filed: Mar. 22, 1996

[51] Int. Cl.[6] ..... F01L 13/00; F01L 1/18

[52] U.S. Cl. ..... 123/90.16; 123/90.43; 123/198 F

[58] Field of Search ..... 123/90.15, 90.16, 123/90.17, 90.27, 90.39, 90.41, 90.43, 90.44, 90.46, 198 F

[56] References Cited

U.S. PATENT DOCUMENTS

| | | | |
|---|---|---|---|
| 4,151,817 | 5/1979 | Mueller | 123/90.16 |
| 4,203,397 | 5/1980 | Soeters, Jr. | 123/90.16 |
| 5,445,116 | 8/1995 | Hara | 123/90.16 |
| 5,513,602 | 5/1996 | Hannibal | 123/90.16 |
| 5,524,580 | 6/1996 | Muir | 123/90.16 |
| 5,529,033 | 6/1996 | Hampton | 123/90.16 |
| 5,544,626 | 8/1996 | Diggs et al. | 123/90.16 |

*Primary Examiner*—Weilun Lo

*Attorney, Agent, or Firm*—Loren H. Uthoff, Jr.

[57] ABSTRACT

A valve control system for an internal combustion engine which does not require synchronization with the engine rotation is disclosed. The system includes an actuator having a coil electrically energized by a control unit causing a stator to magnetically attract an armature where the armature is coupled to a plunger by an actuator spring. The plunger pushes against a pivoted actuator arm having an inner and outer housing which are biased into extension by an arm spring. The actuator arm contacts and forces a slidable latch member into an inactive position and a latch spring returns the latch member into an active position. The system includes an outer rocker arm which is engageable with an engine poppet valve, and an inner rocker arm which is engageable with a cam lobe and the latch member which rotatably links and unlinks the inner and outer rocker arms. The system is adapted wherein the engine poppet valve remains closed when the inner and outer rocker arms are unlinked when the latch member is in the inactive position and wherein the engine poppet valve opens and closes in response to the cam lobe when the inner and outer rocker arms are rotatably linked when the latch member is in the active position. In an alternate embodiment, the plunger contacts a first arm of a pivoted bellcrank and a second arm contacts the latch member.

7 Claims, 7 Drawing Sheets

FIG 3
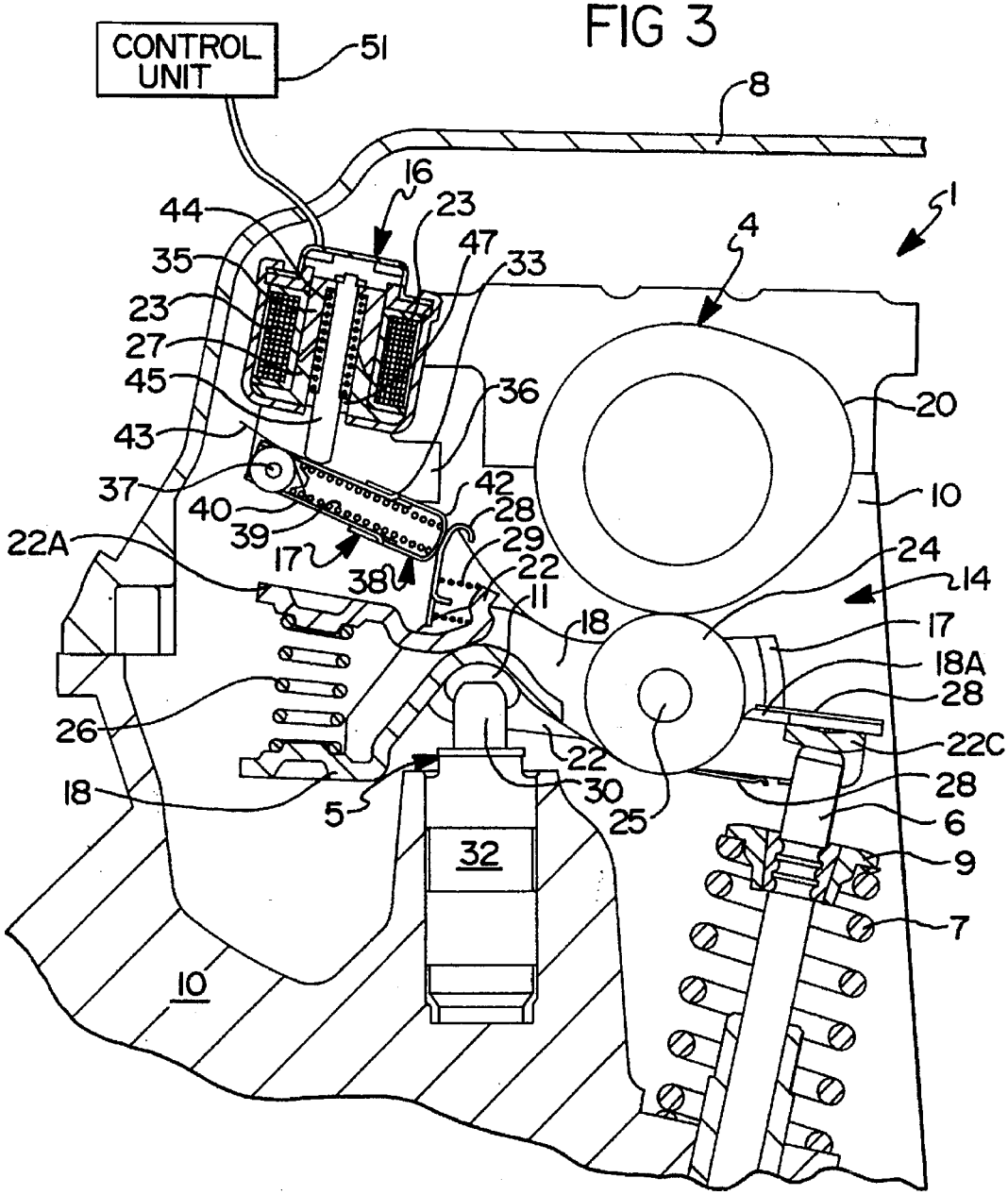
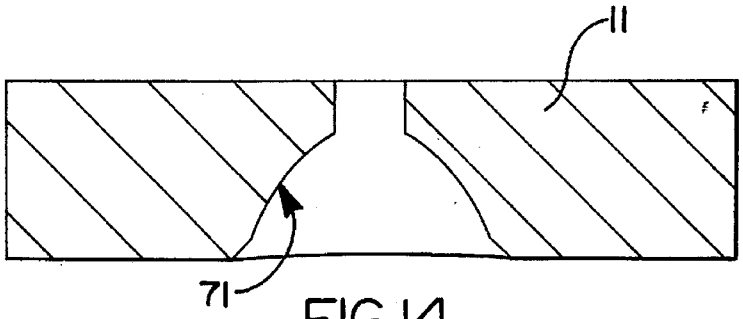
FIG 14

FIG 4
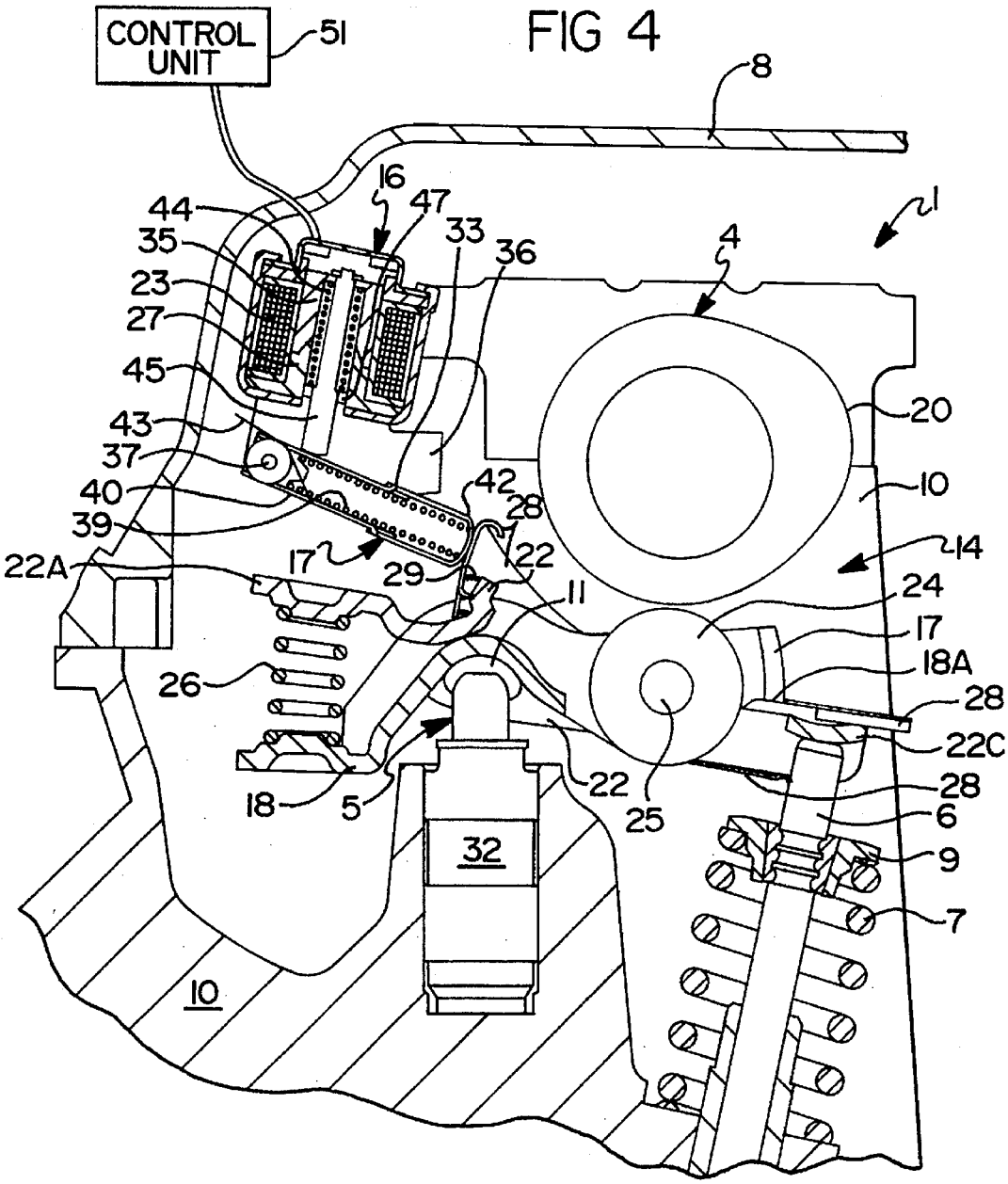
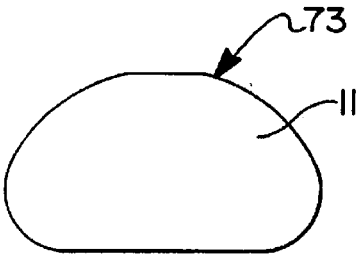
FIG 15

FIG 11
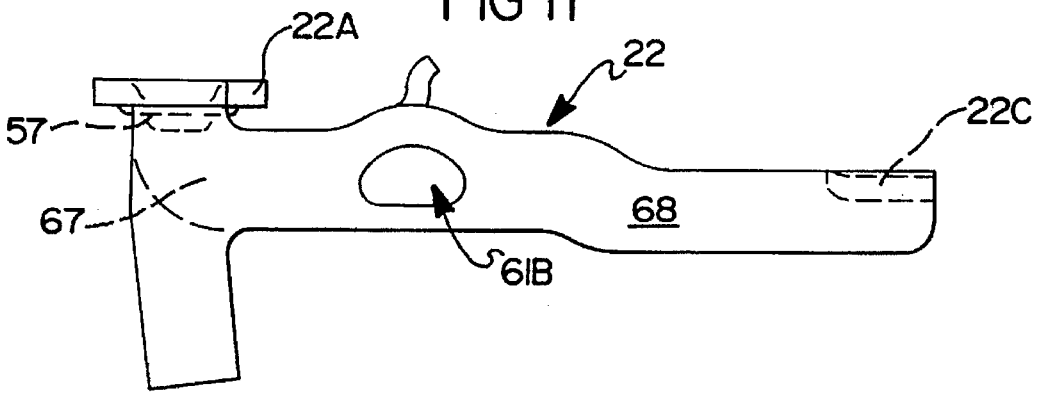
FIG 12
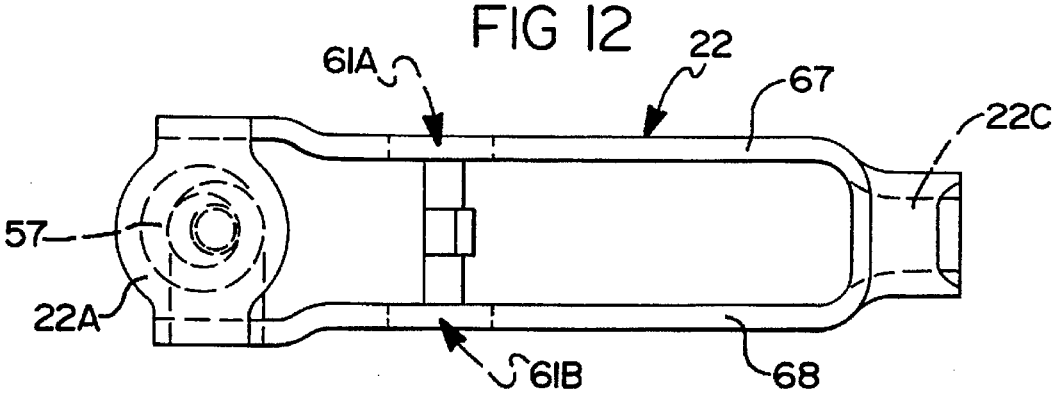
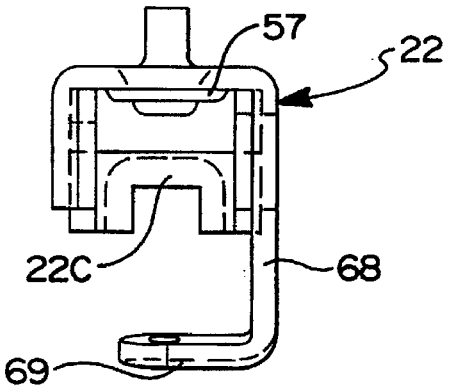
FIG 13

ENGINE VALVE CONTROL SYSTEM USING A LATCHABLE ROCKER ARM ACTIVATED BY A SOLENOID MECHANISM

RELATED APPLICATIONS

This application is related to application U.S. Ser. No. 08/412,474, filed Mar. 28, 1995 entitled "Valve Control System" and U.S. Pat. No. 5,529,033 entitled "Multiple Rocker Arm Valve Control System" and U.S. Ser. No. 08/540,280, filed Oct. 6, 1995 and a continuation application Ser. No. 08/681,319 filed Jul. 22, 1996 entitled "Engine Valve Control System Using A Latchable Rocker Arm" all assigned to the same assignee, Eaton Corporation, as this application.

BACKGROUND OF THE INVENTION

1. Field of the Invention

The present invention relates to a valve operating apparatus for an internal combustion engine and, more specifically, to an apparatus to cause the engine valve to operate or not to operate depending on the energization state of a solenoid actuator.

2. Description of the Prior Art

Variable valve control systems for multiple valve engines wherein the intake and/or exhaust valves can either be selectively actuated or actuated at selected lift profiles, are well known in the art. Example systems are shown in U.S. Pat. Nos. 4,151,817 and 4,203,397 the disclosures of which are hereby incorporated by reference except those portions which also incorporate by reference. U.S. Pat. No. 4,151,817 discloses a primary rocker arm element engageable with a first cam profile, a secondary rocker arm element engageable with a second cam profile, and means to interconnect or latch the primary and secondary arm elements. U.S. Pat. No. 4,203,397 discloses an apparatus to selectively engage or disengage an engine poppet valve so as to connect or disconnect the valve from the rest of the valve gear using a latch mechanism thereby causing the valve to operate or remain stationary.

Latchable rocker arm mechanisms known in the prior art do not provide for a relatively low activation force when the mechanism is to be shifted from either an active state to an inactive state or visa versa. Solenoid actuators, when used with the prior art mechanisms, provide a high force level in order to effectuate the actuation of the latchable rocker arm with some type of motion amplification mechanism such as a bellcrank. It would be desirable, especially for packaging, to provide a latchable rocker arm that requires a low level of solenoid force to effectuate a shift of an engine valve from an active to an inactive state and visa versa without the need for a synchronization system for timing with the rotation of the engine.

SUMMARY OF THE INVENTION

In accordance with the principle of the present invention, a solenoid actuator and an actuator linkage for providing the actuation force required to operate an engine latchable rocker arm (thereby deactivating the engine valve) is disclosed. A solenoid forces a spring loaded plunger against a spring loaded pivoted actuator arm which contacts and displaces a spring loaded latch member so as to uncouple an outer rocker arm from an inner rocker arm. The pivoted actuator arm can only be moved into the position to deactivate the engine valve when the rocker arm is up on the camshaft lobe when the contact pad of the latch member has moved into an engageable position. However, according to the present invention, the actuator spring which contacts the plunger of the solenoid actuator can be compressed if the actuator arm is immovable thereby limiting the force transferred to the actuator arm and allowing the plunger to contact the solenoid stator whenever the solenoid coil is energized. When the actuator arm is free to move on its pivot, the plunger contacts the actuator arm and causes it to rotate to engage the latch member. As the engine valve closes, the latch member is loaded, then an internal spring is compressed within the actuation arm. As the rocker arm encounters the camshaft base circle, the latch member is unloaded and the preloaded spring acting within the actuator arm causes the pivoted actuator arm to move the latch member to a position to decouple the inner and outer rocker arms thereby deactivating operation of the engine valve. As the engine valve closes, if the latch member continues to remain in a loaded condition, the spring in the actuator arm is compressed and preloads the latch member to move into an unlatched inactive position as soon as the latch member is unloaded. Thus, according to the present invention, the actuator can be energized at any time without regard to the position of the engine camshaft using a relatively low power solenoid actuator.

Four separate and distinct springs are used in the solenoid actuator and the actuator linkage; two are used to generate a force to return elements to their normal state and two transmit actuation forces.

In an alternate embodiment, a bellcrank is moved into position by a solenoid actuator. As in the previously described embodiment, the solenoid actuator contains a plunger which operates against a spring to allow the plunger to contact a stator whenever the solenoid coil is energized. The bellcrank applies a force to the latch member as the engine valve is closed thereby displacing the latch member to decouple the inner and outer rocker arms to disable the engine valve.

One aspect of the present invention is to provide a relatively low power solenoid having a spring to couple an armature to a plunger and a linkage mechanism that requires a reduced level of actuation power to cause a latchable rocker arm to activate and deactivate an engine valve.

Another aspect of the present invention is to provide a solenoid actuator which allows an armature to move into contact with a stator while loading a spring against a plunger.

Another aspect of the present invention is that the actuator can be energized at any time without synchronization with the rotation of the engine.

Another aspect of the present invention is to provide a linkage mechanism between an actuator and a latchable rocker arm where the linkage mechanism includes a pivoted telescoping actuator arm having a compression spring contained therein for contacting the latchable rocker arm.

Another aspect of the present invention is to provide a linkage mechanism between an actuator and a latchable rocker arm where the linkage mechanism includes an actuator spring between the plunger and the solenoid armature in combination with a pivoted telescoping actuator arm.

Another aspect of the present invention is to provide a linkage mechanism between a solenoid and a latchable rocker arm where the linkage mechanism includes a pivoted telescoping actuator arm containing an actuator spring and a return spring.

Another aspect of the present invention is to provide a linkage mechanism between an actuator and a latchable rocker arm where the linkage mechanism includes a pivoted bellcrank contacting the solenoid plunger with one arm and contacting the latch member with a second arm.

Another aspect of the present invention is to provide a linkage mechanism between a solenoid having an actuator spring disposed between an armature and a plunger, and a latchable rocker arm where the linkage mechanism includes a pivoted bellcrank operating against a bellcrank return spring with one arm and contacting the latch member thereby compressing a latch spring.

Still another aspect of the present invention is to provide a linkage mechanism between a solenoid and a latchable rocker arm where the linkage mechanism includes a pivoted bellcrank contacting a solenoid plunger having a solenoid spring and a solenoid return spring with one arm and contacting the latch member of a latchable rocker arm with a second arm.

BRIEF DESCRIPTION OF THE DRAWINGS

FIG. 3 is a cross-sectional view of the engine poppet valve control system of the present invention with the solenoid activated and the latchable rocker arm in an enable mode;

FIG. 4 is a cross-sectional view of the engine poppet valve control system of the present invention with the solenoid activated and the latchable rocker arm in a disable mode;

FIG. 11 is an elevational view of the inner rocker arm of the present invention;

FIG. 12 is a top view of the inner rocker arm of FIG. 11;

FIG. 13 is an end view of the inner rocker arm of FIG. 11;

FIG. 14 is a cross-sectional view of the link pin of the present invention;

FIG. 15 is an end view of the link pin of FIG. 14;

DETAILED DESCRIPTION OF THE PREFERRED EMBODIMENT

Figure 1:
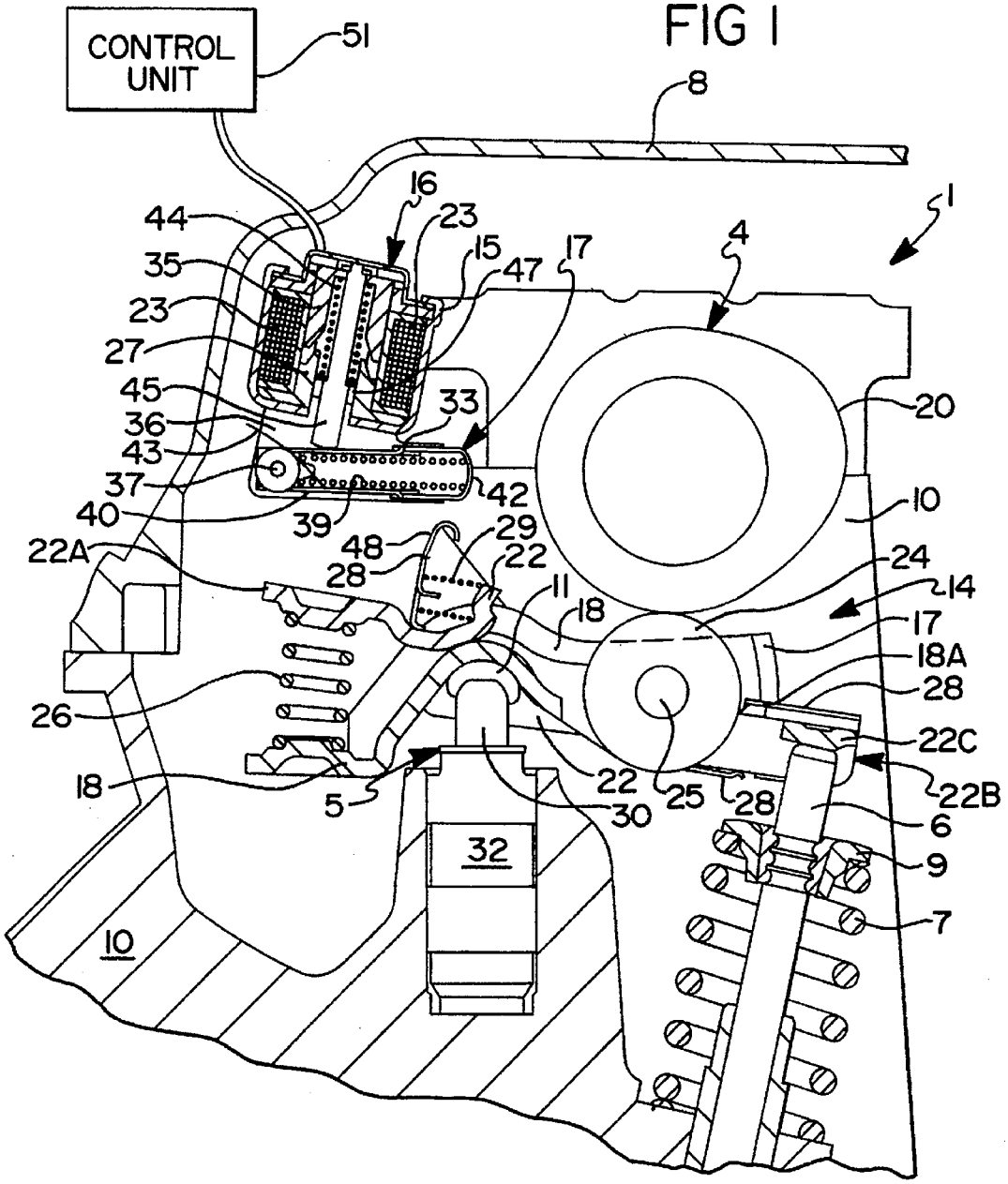
FIG. 1 is a cross-sectional view of the engine poppet valve control system of the present invention installed in an engine valve train.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Certain terminology will be used in the following description for convenience in reference only and will not be limiting. The terms "rightward" and "leftward" will refer to directions in the drawings in connection with which the terminology is used. The terms "inwardly" and "outwardly" will refer to directions toward and away from, respectively, the geometric center of the apparatus. The terms "upward" and "downward" will refer to directions as taken in the drawings in connection with which the terminology is used. All foregoing terms mentioned above include the normal derivatives and equivalents thereof.

Now referring to FIG. 1 of the drawings, a cross-sectional view of the engine poppet valve control system 1 of the present invention installed as part of the valve train on an internal combustion engine is shown. A portion of an engine cylinder head 10 of an internal combustion engine of the overhead cam type is shown along with the camshaft 4, the hydraulic lash adjuster 5, the engine poppet valve 6, the valve spring 7 and the valve cover 8.

As illustrated herein, the engine poppet valve control system 1 is of the type which is particularly adapted to selectively activate or deactivate an engine poppet valve 6 and comprises a rocker arm assembly 14 which is shiftable between an active mode wherein it is operable to open the engine poppet valve 6, and an inactive mode wherein the valve is not opened. An actuator assembly 16 is operable to shift the rocker arm assembly 14 between its active and inactive modes through the movement of an actuator 16 acting through an actuator arm 17.

The rocker arm assembly 14 comprises an inner rocker arm 18 which is engageable with the valve actuating camshaft 4 at the cam lobe 20 supported on the cylinder head 10 of the engine, an outer rocker arm 22 which is engageable with an engine poppet valve 6 which is maintained normally closed by a valve spring 7, and a biasing spring 26 acting between the inner and outer rocker arms 18 and 22 to bias the inner rocker arm 18 into engagement with the camshaft 4 through the roller follower 24 and the outer rocker arm 22 into engagement with the plunger 30 which rides in the main body 32 of lash adjuster 5. The construction and the function of the lash adjuster 5 are well known in the art and will not be described in detail herein. The biasing spring 26 applies sufficient force to the plunger 30 to keep the lash adjuster 5 operating in its normal range of operation at all times.

A latch member 28 is slidably received on the outer rocker arm 22 and biased into a "latched" condition by latch spring 29, the latch member 28 is effective to latch the inner and outer rocker arms 18 and 22 so that they move together to define the "active mode" of the engine popper valve control system of the present invention or to unlatch them where the inner and outer rocker arms 18 and 22 are free to rotate relative one to the other to define the "inactive mode". A link pin 11 passes through coaxial apertures 61A and 61B formed in the outer rocker arm 22 (see FIG. 11) and through a link pin aperture 21 formed in the latch member 28 and provides pivotal support to the outer rocker arm 22 where the link pin 11 pivots on the plunger 30. In the preferred embodiment of the invention, the inner rocker arm 18 is pivotally supported on the link pin 11 and the outer rocker arm 22 is nonrotatably mounted on link pin 11 where the link pin 11 is supported pivotally by plunger 30 of the lash adjuster 5.

The outer rocker arm 22 is an elongated rectangular structure having opposed side walls, and a first end 22A for engaging a biasing spring 26 and a second end 22B having a valve engagement surface 22C formed thereon. The valve engagement surface 22C is in contact with the engine poppet valve 6. The inner rocker arm 18 is an elongated rectangular structure received between the opposed side walls of the outer rocker arm 22 (see FIG. 5). The inner rocker arm 18 has a contact surface 18A formed thereon engageable with the latch member 28 when the rocker arm assembly 14 is in the normal active mode.

The electromagnetic actuator assembly 16 is shown in a nonenergized state in FIG. 1 which allows the latch spring 29 to force the latch member 28 into a position to provide actuation of the engine poppet valve 5 by the camshaft 4 through the rocker arm assembly 14 in the active mode. Any type of suitable actuator could be utilized to provide a linear motion such as a hydraulic piston or vacuum powered piston or a rotary motor using a cam mechanism. The actuator assembly 16 consists of a circular armature 35 which is electromagnetically attracted toward the stator 27 when an electrical current is supplied to the coil 23 by the control unit 51. The plunger 45 is slidingly attached to the armature 35 and is biased along with the armature 35 away from the stator 27 by a solenoid spring 44 loaded in compression. The solenoid spring 44 pilots on the plunger 45 and is retained in a static position at one end against the armature 35 and at a second end by collar 47 which is secured to the plunger 45. Thus, the solenoid spring 44 effectively limits the amount of force that is transferred from the armature 35 to the plunger 45 by the spring rate of the solenoid spring 44 multiplied by the relative displacement between the armature 35 and the plunger 45 plus the preload force on the solenoid spring 44. For example, with a solenoid spring 44 having a spring rate of 1.0 Newtons/millimeter and a preload of 5.0 Newtons, a maximum force of 7.0 Newtons could be generated against the plunger 45 assuming a maximum solenoid armature travel of 2.0 mm. The present invention provides for the generation of a highly repeatable action of the plunger 45 irrespective of changes in coil resistance due to temperature and/or changes in coil voltage.

If the latch member 28 is loaded by a clamping force generated by the inner and outer rocker arms 18 and 22 and unable to be moved into an inactive mode and the actuator arm will be unable to be moved down. Upon energization of the stator 27, the armature 35 can load the solenoid spring 44 which provides for lost motion between the actuator armature 35 and the plunger 45 but provides a force against the actuator arm 17. Thus, the armature 35 moves to contact the stator 27 and compresses the solenoid spring 44 and thereby applies a force against the plunger 45 through the collar 47. If possible, the plunger 45 contacts and forces the actuator arm 17 downward to engage the latch member 28. Just as poppet valve 6 closes, latch member 28 compresses arm spring 39 since latch member 28 is still loaded. As soon as the latch member 28 becomes unloaded, the preloaded arm spring 39 forces it into a position so that the rocker arm assembly 14 is in the inactive mode. The latch spring 29 has one end contacting the outer rocker arm 22 and a second end which contacts the latch member 28 thereby biasing the latch member 28 leftward so as to engage the inner rocker arm 18 to activate the engine poppet valve 6. If the latch member 28 is unloaded, the actuator arm 17 overcomes the force of the latch spring 29 and moves the latch member 28 rightwardly into the inactive mode where the engine poppet valve 6 does not open and close in response to the cam lobe 20.

The actuator arm 17 pivots on arm pin 37 and is secured to the guide housing 36 which is attached to the actuator assembly 16. The actuator arm 17 contacts the latch member 28 at contact pad 48 which is formed as part of the latch member 28. The latch member 28 is biased toward a position to activate the engine poppet valve 6 (active mode) by the latch spring 29 which acts upon the latch member 28 against the outer rocker arm 22.

The biasing spring 26 is preloaded to maintain a load between the roller follower 24 rotating on roller pin 25 and the camshaft 4 sufficient to keep the lash adjuster 5 operating in its normal range of adjustment. Changes in the preload on the biasing spring 26 can be made by changing the position of the preload adjuster 31 (see FIG. 5) thereby altering the position of the plunger 30 in the main body 32 of the lash adjuster 5.

FIG. 1 illustrates the valve control system 1 in an inactive position where the actuator assembly 16 has not been energized by control unit 51 and the armature 35 is not yet magnetically attracted so as to move to come in contact with the stator 27. The solenoid spring 44 acts against the collar 47 pushing against the plunger 45 which in turn pushes against the actuator arm 17 in response to movement of the armature 35. The actuator arm 17 has an inner arm spring 39 which separates an inner housing 40 from a telescoping outer housing 42 where stop pin 33 prevents total separation of the inner and outer housings 40 and 42. Inner housing 40 is hinged to the guide housing 36 by arm pin 37 and contacts the plunger 45 due to return spring 43 which biases the actuator arm 17 upward. If the rocker arm assembly is in an unloaded condition where the cam lobe 20 is contacting the roller follower 24 on the base circle, then the actuator assembly 16 is energized. If the valve 6 is closed, the actuator arm 17 contacts the latch member 28 hitting on top of the contact pad 48. When the valve 6 opens, the actuator arm 17 is pushed by the plunger 45 into the face of the contact pad 48. As the valve 6 closes, the arm spring 39 is further compressed thereby preloading the latch member 28. When the latch member 28 is unloaded when the roller follower 24 contacts the base circle of the cam lobe 20, the latch member 28 is forced rightward, thereby shifting the rocker arm assembly 14 into the inactive mode. When the actuator assembly 16 is nonenergized as shown in FIG. 1, or the latch member 28 is loaded, the latch member 28 links the inner rocker arm 18 to the outer rocker arm 22 and the engine poppet valve 6 is activated.

Thus, there are five springs involved in the valve control system 1 of the present invention: the biasing spring 26, the actuator spring 44, the arm spring 39, the return spring 43 and the latch spring 29. All except return spring 43 (which is a torsional spring) are coil springs loaded in compression. The actuator spring 44 is loaded in compression and functions to separate the armature 35 from the stator 27 and also functions to limit the force and motion transferred to the actuator arm 17 since one end of the actuator spring contacts the armature 35 and the second end contacts the collar 47 which is attached to the plunger 45. The armature 35 is slidingly coupled to the plunger 45 such that the plunger 45 moves in response to the force generated by the actuator spring 44 and not directly to the displacement of the armature 35. As shown in FIG. 1, if the rocker arm assembly 14 has not been moved by the cam lobe 20 to open the valve 6, the actuator arm 17 will hit the top of the latch member 29. Thus, the actuator spring is compressed by the armature 35 and applies an increased force on the plunger 45 which does not move. One advantage of the present invention is that the solenoid spring 44 allows the armature 35 to move to contact the stator 27 anytime that the coil 23 is energized by the control unit 51. Thus, special timing circuits are not required to synchronize the valve control system 1 with the rotation of the camshaft 4. Also, if solenoid power is to be minimized, the solenoid 16 can be designed to not have sufficient force to overcome the latch return spring 29 where movement of the actuator arm 17 (or bellcrank 70 in FIG. 16) will only occur when the valve 6 is open.

The arm spring 39 is loaded in compression so as to supply a separation force between the inner housing 40 and the outer housing 42 which combine to make up the actuator arm 17. The inner housing 40 is rotationally coupled to the guide housing 36 by arm pin 37. The inner housing 40 and the outer housing 42 are limited in relative axial translation by the link pin 33. The arm spring 39 allows the actuator arm 17 to be compressed in length if the inner rocker arm 18 is loaded against the latch member 28 at contact surface 18A such that the latch member 28 cannot be moved by the actuator arm 17 (see FIG. 3). It also allows the actuator arm 17 to be moved downward to contact the latch member 28 when the rocker arm assembly 14 is moved by the cam lobe 20 to the open valve position. In this case, the arm spring 39 preloads the actuator arm 17 to continuously supply a force on the latch member 28 until the inner rocker arm 18 unloads the latch member 28 when the roller follower 24 contacts the base circle of the cam lobe 20 when the valve closes.

The return spring 43 is grounded to the guide housing 36 at one end and contacts the actuator arm 17 at a second end so as to supply a force to the actuator arm 17 in the upward direction toward the actuator assembly 16.

The latch spring 29 is loaded in compression and contacts the latch member 28 at one end and the outer rocker arm 22 at a second end. Thus, the latch spring 29 biases the latch member 28 such that the rocker arm assembly 14 is normally in an active mode where the latch member 28 links the inner rocker arm 18 to the outer rocker arm 22 to operate the engine valve 6 in response to the cam lobe 20. The spring rate of the latch spring 29 is lower in value than that of the arm spring 39.

Figure 2:
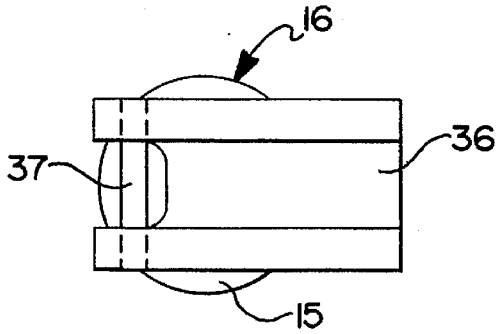
FIG. 2 is a partial sectional view of the solenoid actuator of the present invention taken along line 2—2 of FIG. 1.

Now referring to FIG. 2, a partial elevational view of the actuator assembly 16 of the present invention is shown. The arm pin 37 extends through the guide housing 36 and rotationally engages the actuator arm 17 (not shown). The solenoid housing 15 is shown as circular in shape although any suitable shape could be utilized as known in the solenoid art.

Now referring to FIG. 3, a cross-sectional view of the valve control system 1 of the present invention is shown. The actuator assembly 16 has been energized by the control unit 51 and the actuator arm 17 has been rotated by action of the plunger 45 to engage the latch member 28 when the cam lobe 20 engaged the roller follower 24 and caused the rocker arm assembly 14 to be rotated on the plunger 30 thereby allowing the actuator arm 17 to engage the latch member 28. Thus, the valve control system 1 of the present invention does not have to be timed to the rotation of the camshaft 4. The latch member 28 has just been unloaded from the inner rocker arm 18 and both the arm spring 39 and the latch spring 29 have been further compressed as compared to that shown in FIG. 1. Thus, in FIG. 2, the latch member 28 has been moved slightly rightward and is shown preloaded by the compression of arm spring 39 and the latch spring 29 to move fully rightward so as to disengage the inner rocker arm 18 from the outer rocker arm 22 when the latch member 28 is fully unloaded.

Now referring to FIG. 4, a cross-sectional view of the valve control system 1 of the present invention is shown where the rocker arm assembly 14 is in the inactive mode. The actuator arm 17 is shown fully extended by the arm spring 39 and has moved the latch member 28, which is unloaded, fully to the right thereby unlinking the inner rocker arm 18 and the outer rocker arm 22. The rocker arm assembly 14 is in the inactive mode where the engine poppet valve 6 does not open in response to the cam lobe 20. The latch spring 29 is compressed by the actuator arm 17 since the preload and rate of the arm spring 39 is higher than the preload and rate of the latch spring 29.

Figure 5:
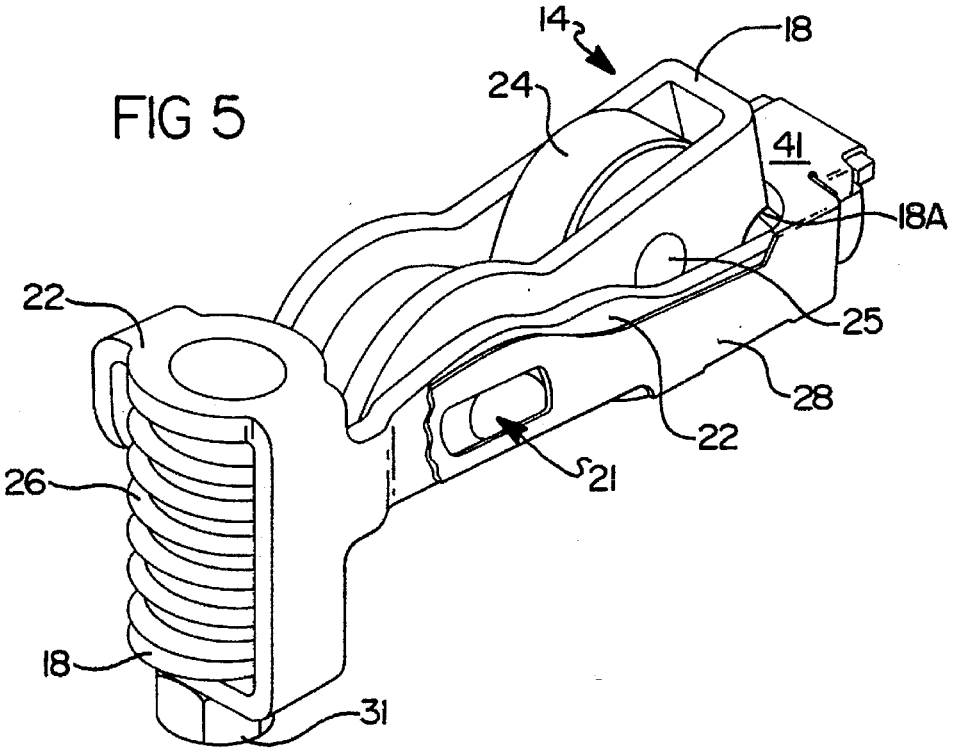
FIG. 5 is a partial perspective view of the rocker arm assembly of the present invention.
Figure 6:
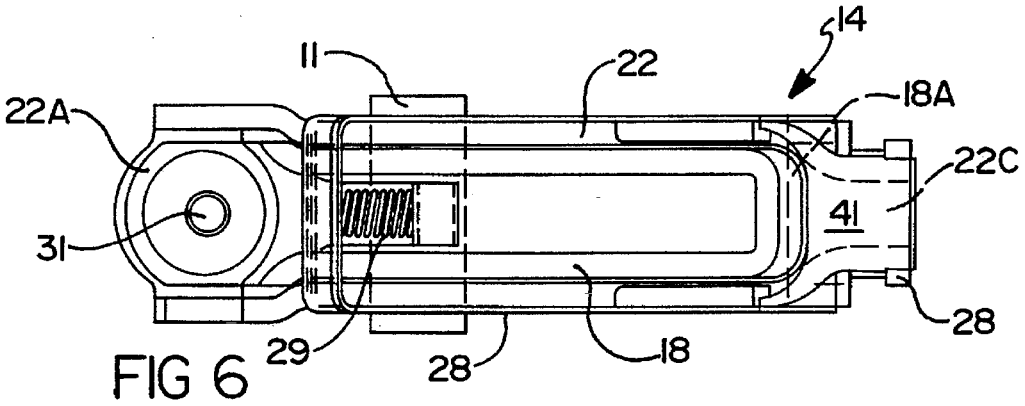
FIG. 6 is a top elevational view of the rocker arm assembly of the present invention.
Figure 7:
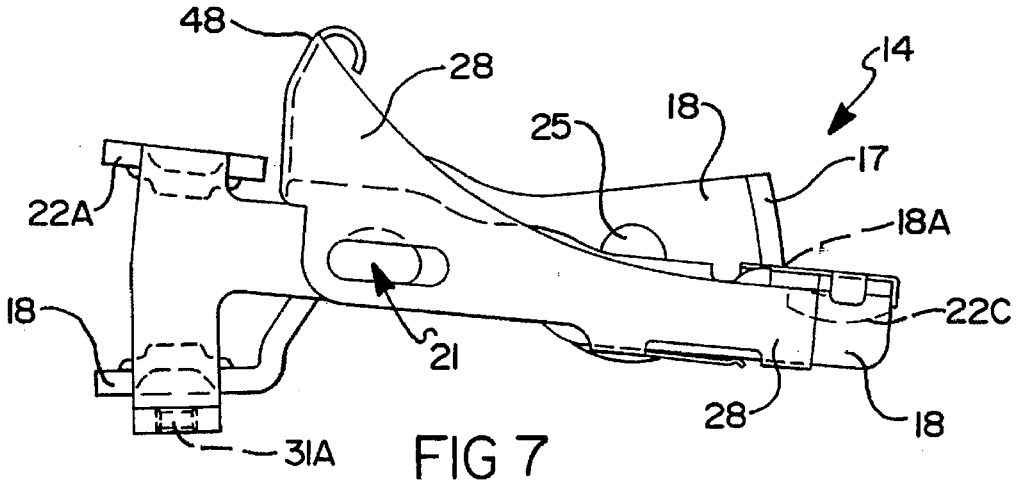
FIG. 7 is a side elevational view of the rocker arm assembly of the present invention.

Reference to FIGS. 5, 6 and 7 is now made to provide a better understanding of the operation of the rocker arm assembly 14. The perspective view of the rocker arm assembly 14 as shown in FIG. 5 illustrates the inner rocker arm 18 surrounded by the outer arm 22 where the inner rocker arm 18 contacts and pivots on the link pin 11 (see FIG. 1) while the outer rocker arm 22 when linked to the inner rocker arm 18 by latch member 28 contacts and actuates the engine poppet valve 5 when the latch member 28 is in the active position. The cam roller follower 24 rotates on roller pin 25 which is supported in the inner rocker arm 18. The latch member 28, which is only partially shown, is biased into the active position by the latch spring 29 where the contact plate 41 contacts the inner rocker arm at contact surface 18A and is supported by the outer rocker arm 22 when the rocker arm assembly is in the active mode.

The link pin 11 (see FIG. 1) holds the inner and outer rocker arms 18 and 22 and the latch member 28 in the proper orientation while allowing relative rotation between the inner and outer rocker arms 18 and 22, and axial motion of the latch member 28 due to the elongated link pin aperture 21 formed in both sides of latch member 28. The link pin 11 extends through the latch member 28 and the outer rocker arm 22 while the inner rocker arm 18 pivots over link pin 11 and retains the three elements in the proper orientation while pivoting on the lash adjuster 5.

The latch member 28 has a contact plate 41, the position of which determines when the rocker arm assembly 14 is in an active or inactive mode. When the latch member 28 is moved toward the inner rocker arm 18, the rocker arm assembly 14 is in the active mode and the latch member 28 provides a mechanical link between the inner and outer rocker arms 18 and 22 to open the engine poppet valve 6 in response to the camshaft 4 acting on the roller follower 24. When the latch member 28 is moved away from the inner rocker arm 18, the rocker arm assembly 14 is placed in an inactive mode where the inner arm 18 is not linked to the outer arm 22 and the engine poppet valve 6 is closed. As the contact plate 41, as part of the latch member 28, is moved toward the inner rocker arm 18, the contact plate 41 catches an edge of the inner rocker arm 18 at contact surface 18A and thereby mechanically links the inner and outer rocker arms 18 and 22 causing the engine poppet valve 6 to open and close in response to the cam lobe 20. As the contact plate 41 is moved away from the inner rocker arm 18, the inner rocker arm 18 no longer contacts the contact plate 1 and the inner rocker arm 18 moves in response to the camshaft 4 but its motion is not transferred to the outer rocker arm 22 or the engine poppet valve 6. When the rocker arm assembly is in the inactive mode, the inner rocker arm 18 pivots over the link pin 11 at the plunger 30 and compresses the biasing spring 26 which is supported at one end by the inner rocker arm 18 and at a second end by the outer rocker arm 22. Thus, the biasing spring 26 functions to maintain contact between the cam roller follower 24 and the cam lobe 20 and to provide the proper compression load on the lash adjuster 5. The initial preload/position on the biasing spring 26 can be changed with the preload adjuster 31.

FIG. 6 is an elevational view of the rocker arm assembly 14 of the present invention. The link pin 11 extends through the outer rocker arm 22 providing a rotational support on the plunger 30. The latch member 28 couples the inner rocker arm 18 to the outer rocker arm 22 at contact plate 41 and contact surface 18A which is part of the inner rocker arm 18. The latch spring 29 functions to bias the latch member 28 leftward to cause the latch member 28 to engage the contact surface 18A and normally shift the rocker arm assembly into the active mode.

Now referring to FIG. 7, an elevational view of the rocker arm assembly 14 of FIG. 6 is shown. The link pin 11 (see FIG. 5) passes through the link pin aperture 21 which extends through the latch member 28, the outer rocker arm 22 and the inner rocker arm 18 pivots over it. The aperture 21 is elongated in the latch member 28 as compared to the outer rocker arm 22 to allow for the axial movement when the rocker arm assembly 14 is shifted from the active to the inactive mode. Thread 31A accommodates the preload/position adjuster 31 for adjustment of the preload/position on biasing spring 26 that regulates the amount of clearance between the inner rocker arm 18 and the outer rocker arm 22 at contact plate 41 thereby setting the operating clearance for each individual rocker arm assembly 14. When the rocker arm assembly 14 is disengaged, the spring takes up any lost motion and holds the roller follower 25 against the cam lobe 20. When the rocker arm assembly 14 is engaged, the valve spring holds the follower 25 against the cam lobe. Changes in the preload/position adjuster 31 alters the depth of the plunger 30 into the lash adjuster 5 and alters the clearance between the inner and outer rocker arms 18, 22 at the contact plate 41.

In summary, FIGS. 6 and 7 show top and side plan views of the rocker arm assembly 14 of the present invention. The inner rocker arm 18 is generally surrounded by the outer rocker arm 22 where the latch member 28 is moved to cause the contact plate 41 to contact the inner rocker arm 18 for activation of the engine poppet valve 6 (active mode) or to not contact the inner rocker arm 18 for decoupling of the inner rocker arm 18 from the outer rocker arm 22 and deactivation of the engine poppet valve 6 (inactive mode). The latch spring 29 contacts the inner rocker arm 18 and the latch member 28 and provides a spring bias to force the latch member 28 leftward and specifically the contact plate 41 toward the inner rocker arm 18. Thus, the latch member 28 is spring biased toward the active mode.

Figure 8:
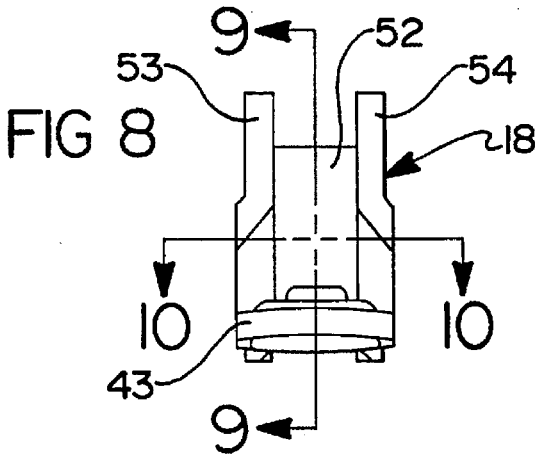
FIG. 8 is a front elevational view of the outer rocker arm assembly of the present invention.

FIG. 8 is an elevational view of the inner rocker arm 18 of the present invention. The inner rocker arm 18 consists of two side walls 53 and 54 and a web portion 52 connecting the side walls 53 and 54. The lower spring support 43 is attached and formed as part of the web portion 52.

Figure 9:
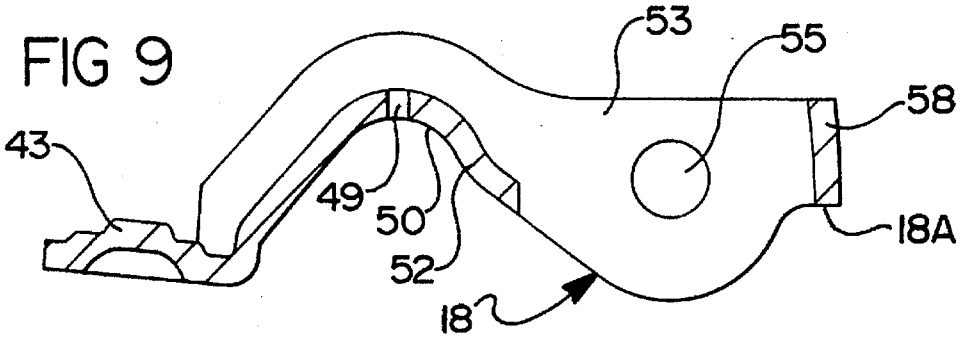
FIG. 9 is a sectional view of the outer rocker arm taken along line 9—9 of FIG. 8.

FIG. 9 is a cross-sectional view of the inner rocker arm 18 of FIG. 7 taken along line 9—9. The web portion 52 of the inner rocker arm 18 is shown having an oil drain 49 formed in a location coinciding with the area of the inner rocker arm 18 that contacts and pivots over the link pin 11 on saddle portion 50 (see FIG. 1). A pin aperture 55 is formed in both of the side walls 53 and 54 to provide for support of the roller pin 25. An end portion 58 forms contact surface 18A which contacts the contact plate 41 (see FIG. 2) when the rocker arm assembly 14 is in the active mode. In the active mode, the actuator assembly 16 is not energized or the actuator assembly 16 has been energized by the control unit 51 and the latch member remains loaded thereby preventing movement and the latch spring 29 biases the latch member 28 into engagement.

Figure 10:
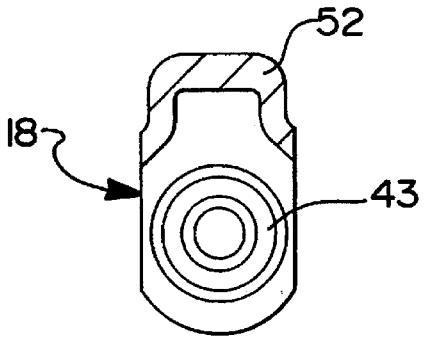
FIG. 10 is a sectional view of the outer rocker arm taken along line 10—10 of FIG. 8.

FIG. 10 is a cross-sectional view of the inner rocker arm 18 of FIG. 7 taken along line 10—10. The web portion 52 extends to form the lower spring support 43 on which the biasing spring 26 rides. Also the preload adjuster 31 contacts the side of the lower spring support 43 opposite to that of the biasing spring 26 to provide for adjustment of the relative length between the inner rocker arm 18 and the outer rocker arm 22 with the biasing spring 26 mounted therebetween thereby altering the position stop on the biasing spring 26 and the depth of the plunger 30 into the main body 32 of the lash adjuster 5.

Referring now to FIGS. 11–13, various views of the outer rocker arm 22 of the present invention are shown. FIG. 11 is a side elevational view of the outer rocker arm 22 where a link pin aperture 61 is formed in both side walls 67 and 68 to provide support for the link pin 33. At the first end 22A of the outer rocker arm 22, an upper spring support 57 is formed which, in conjunction with the lower spring support 43 found in the inner rocker arm 18 provides a secure mounting arrangement for the biasing spring 26. Thus, the biasing spring 26 provides a separation force between the inner and outer rocker arms 18 and 22 and forces the roller follower 24 into contact with the cam lobe 20 and loads the plunger 30 of the lash adjuster 5. A valve contact pad 59 is provided at the second end 22B of the outer rocker arm 22 for contacting the top of the valve stem of engine poppet valve 6 at valve engagement surface 22C.

FIG. 12 is a top view of the outer rocker arm 22 of FIG. 10 more clearly showing the side walls 67 and 68 and both link pin apertures 61A and 61B which combine to form part of the link pin aperture 21. FIG. 13 is an end view of the outer rocker arm 22 of FIG. 11 more clearly showing the valve engagement surface 22C which contacts the end of the engine poppet valve 6 thereby transferring the motion provided by the camshaft 4 and the inner rocker arm 18 to the engine poppet valve 6 when the rocker arm assembly 14 is in an active mode. It also illustrates how the side wall 68 is formed to provide a support portion 69 for the preload adjuster 31 (see FIGS. 5 and 13).

FIG. 14 is a cross-sectional view of the link pin 11 showing the pivoting section 71 where the link pin 11 contacts and pivots on the plunger 30. FIG. 15 is an end view of the link pin 11 showing the semicircular shape which allows the saddle portion 50 of the inner rocker arm 18 to pivot on the support surface 73 of the link pin 11.

Figure 16:
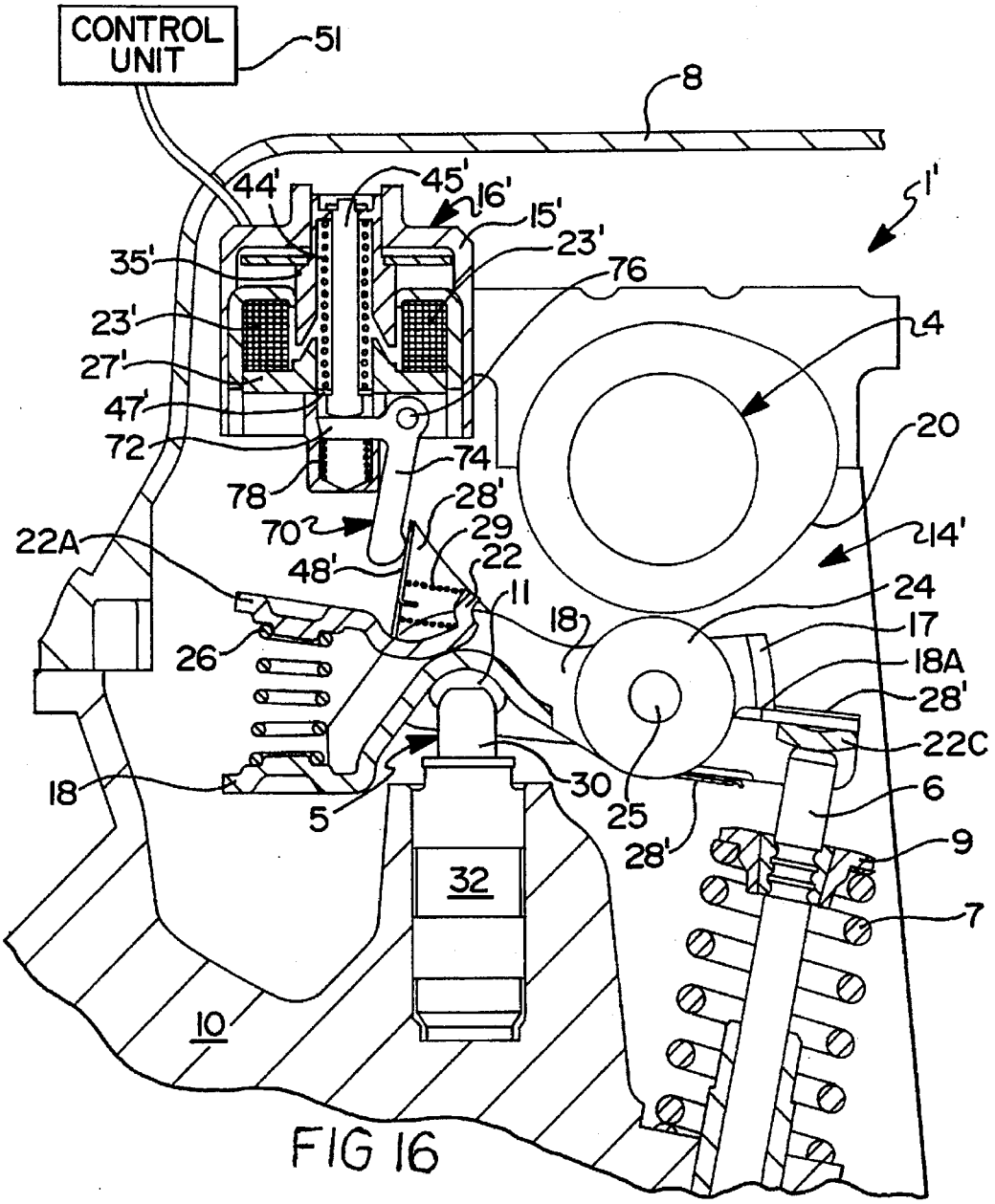
FIG. 16 is a cross-sectional view of an alternate embodiment of the present invention.

Now referring to FIG. 16, a cross-sectional view of an alternate embodiment of the present invention is shown. The actuator assembly 16' operates against a dual arm bellcrank 74 where the plunger 45' pushes against the first arm 72 of bellcrank 74 which pivots on pin 76 and the second arm 70 contacts the contact pad 48' of latch member 28' of rocker arm assembly 14'. The latch spring 29 is compressed between the contact pad 48' of latch member 28' and the outer rocker arm 22.

The actuator assembly 16' is comprised of a solenoid having a case 15' and a coil 23' which is electrically energized by control unit 51 to create an electromagnetic field in stator 27' which magnetically attracts the armature 35' thereby compressing the actuator spring 44' against the retainer 47' which is attached to the plunger 45'. The plunger 45' is slidingly connected to the armature 35'. Upon energization of the coil 23', the plunger 45' is forced downward against the first arm 72 which moves and further compresses return spring 78 which is preloaded to force the bellcrank 70 clockwise to maintain contact between the first arm 72 and the plunger 45'.

The second arm 74 of bellcrank 70 contacts the contact pad 48' and acts to force the latch member 28' rightward when the actuator assembly 16' is energized to shift the rocker arm assembly 14' into an inactive mode.

Figure 17:
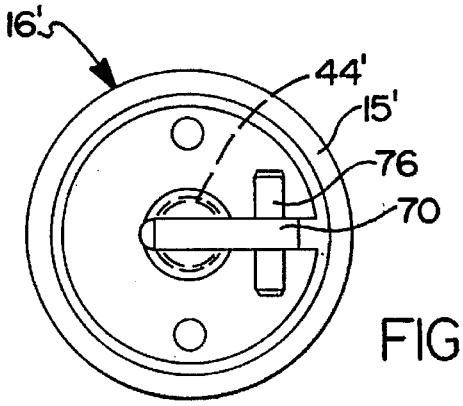
FIG. 17 is an end view of the solenoid actuator shown in FIG. 14.

Now referring to FIG. 17, a partial bottom view of the solenoid actuator assembly 15' of the present invention is shown. The bellcrank 70 is rotatably supported on pin 76 which engages the case 15' of the solenoid actuator assembly 15'. The actuator spring 44' pushes against the plunger 45' and subsequently the bellcrank 70. The return spring 78 is not shown. Although the solenoid case 15' is shown as circular in cross-section, any shape could be utilized as known in the solenoid art.

While the invention has been illustrated and described in some detail in the drawings and foregoing description, the same is to be considered as illustrative and not restrictive in character, it being understood that only the preferred embodiment has been shown and described and that all changes and modifications that come within the spirit of the invention are to be considered within the scope of the invention and only limited by the following claims.

We claim:

1. A valve control system for an internal combustion engine including a cylinder head, an engine poppet valve and a camshaft having a cam lobe formed thereon, said control system comprising:

a lash adjuster mounted on said cylinder head having a lash adjuster plunger;

a link pin adapted to pivot on said plunger;

an outer rocker arm nonrotatably supported on said link pin and engageable with said engine popper valve;

an inner rocker arm having a saddle portion for rotatably contacting said link pin and adapted for rotation relative to said outer rocker arm, said inner rocker arm engaging said cam lobe;

a biasing spring contacting said inner rocker arm and said outer rocker arm for forcing said outer rocker arm into engagement with said popper valve and said inner rocker arm into contact with said cam lobe;

a slidable latch member for selectively linking said inner rocker arm and said outer rocker arm for rotation in unison with said link pin about said pivot point in response to a force applied by said cam lobe to said inner rocker arm, and for selectively unlinking said inner and said outer rocker arms for independent rotation, said latch member extending from approximately one end of said outer rocker arm at said poppet valve along said outer rocker arm toward said link pin;

actuation means for applying a force and a displacement; and an actuator arm pivoted at a first end and contacting said latch member at a second end upon application of a force generated by said actuation means, said actuator arm being variable in length and having an arm spring acting thereon to bias said actuator arm to an extended position.

2. The valve control system of claim 1, wherein said actuator arm has an inner housing and an outer housing, said inner housing slidably engaging said outer housing and forced apart by said arm spring.

3. The valve control system of claim 2, wherein said arm spring is disposed within said inner housing and said outer housing.

4. The valve control system of claim 1, further comprising a return spring acting on said actuator arm to bias said actuator arm toward said actuation means.

5. The valve control system of claim 1, wherein said actuation means is a solenoid electrically connected to a control unit where said control unit supplies an electrical current to a coil contained within said solenoid thereby causing an armature to be magnetically attracted to a stator, said stator being magnetized by said coil.

6. The valve control system of claim 5, further comprising an actuator spring acting between said armature and a plunger contained within said solenoid, said plunger being slidably connected to said armature at a first end and contacting said actuator arm at a second end where said actuator spring contacts said armature at a first end and contacts said plunger at a second end whereby said actuator spring becomes further compressed when said armature is moved toward said stator and said plunger remains relatively stationary.

7. The valve control system of claim 1, further comprising a latch spring having a first end contacting said latch member and a second end contacting said outer rocker arm, said latch spring biasing said latch member toward a position to rotatably link said inner rocker arm to said outer rocker arm.

* * * * *